United States Patent [19]

Shappell

[11] Patent Number: 4,989,124

[45] Date of Patent: Jan. 29, 1991

[54] SOLAR POWERED SIGN

[76] Inventor: Thomas E. Shappell, 40 Heritage Dr., Reading, Pa. 19607

[21] Appl. No.: 396,352

[22] Filed: Aug. 21, 1989

[51] Int. Cl.[5] ..... G09F 11/02; G09F 13/00

[52] U.S. Cl. ..... 362/183; 40/433; 40/435; 40/466; 40/474; 136/291; 136/245

[58] Field of Search ..... 362/183; 40/429, 430, 40/433, 466, 470, 474, 435; 136/245, 246, 291

[56] References Cited

U.S. PATENT DOCUMENTS

| | | | |
|---|---|---|---|
| 2,091,392 | 8/1937 | Linstrom | 40/474 |
| 3,030,944 | 4/1942 | Blau et al. | 40/435 |
| 3,417,498 | 12/1968 | Antony | 40/470 |
| 4,470,213 | 9/1984 | Thompson | 40/473 |
| 4,747,567 | 5/1988 | Johnson et al. | 136/245 |
| 4,764,850 | 8/1988 | Albanese | 362/35 |

*Primary Examiner*—Allen M. Ostrager
*Attorney, Agent, or Firm*—H. Jay Spiegel

[57] ABSTRACT

The present invention relates to an improved solar powered sign including one or more solar panels used to charge batteries which power various components of the sign. The sign may include a rotary display which is electrically powered and may also include a lamp. The sign may be mounted on a base facilitating easy transport.

11 Claims, 4 Drawing Sheets

SOLAR POWERED SIGN

BACKGROUND OF THE INVENTION

The present invention relates to an improved solar powered sign. In the prior art, the use of solar power in displays is known. However, applicant is unaware of any prior art teaching a sign including all of the aspects of the present invention.

Applicant is aware of the following U.S. Pat. Nos: 2,059,296 to Whitworth, 4,108,405 to Gibson, and 4,481,562 to Hickson. Whitworth teaches the concept of the use of repeated reciprocations of a solenoid to rotate a display. Gibson teaches the concept of a sign which is powered by a solar cell, while Hickson teaches the concept of the use of solar power to provide illumination and recharge batteries.

However, none of these patents teaches all of the aspects of the present invention in the manner contemplated herein.

SUMMARY OF THE INVENTION

The present invention relates to an improved solar powered sign. The present invention includes the following interrelated aspects and features:

(a) In a first aspect, the inventive sign includes a housing in which electronic circuitry may be contained.

(b) The housing may be mounted on a base consisting of, for example, a pair of drums. Alternatively, the housing could be mounted on a trailer for easy transport.

(c) Mounted on the housing are two solar panels which may lie closely adjacent the housing during storage or transport, but which may be pivoted outwardly to an operative position when the sign has been placed in a desired location.

(d) The solar panels receive energy from the sun and through suitable electrical conductors transmit this energy to an electronic circuit.

(e) The electronic circuit includes means for rotating a portion of the display, which means may, if desired, consist of a one-way bearing known in the art as a Torrington bearing.

(f) A water trough and drain may be provided in the housing to collect and drain any water or other liquids which may accumulate therein.

(g) Illumination means may be provided to illuminate the fixed and moving portions of the sign.

Accordingly, it is a first object of the present invention to provide an improved solar powered sign.

It is a further object of the present invention to provide such a sign including fixed and movable portions thereof.

It is a yet further object of the present invention to provide such a sign including one or more solar panels which may be swung out to an operative position from a stored position.

It is a yet further object of the present invention to provide such a sign wherein the movable portion may consist of a rotary display actuated by a one-way bearing.

It is a yet further object of the present invention to provide such a sign which may include illumination means.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
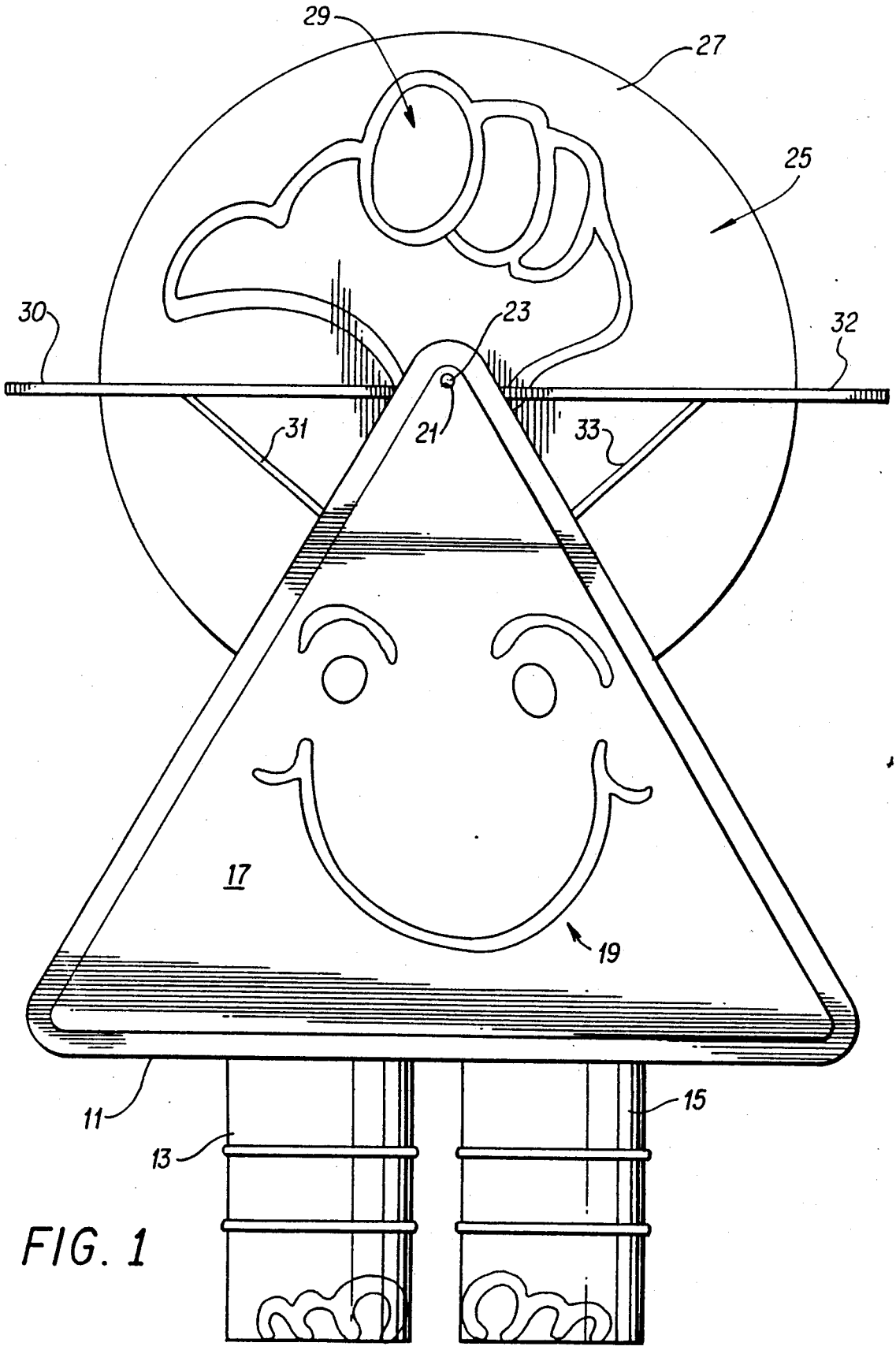
FIG. 1 shows a front view of the preferred embodiment of the present invention.

With reference to FIG. 1, the inventive sign is generally designated by the reference numeral 10 and is seen to include a base 11 shown in the figure mounted on two barrels 13, 15. As will be described in greater detail hereinafter, with particular reference to FIG. 5, the base 11 may be mounted on other structures.

With reference back to FIG. 1, the base 11 includes a front face 17 having an aesthetic design such as the smiling face 19 shown in the figure. At the top of the front face 17, an opening 21 is provided through which is received the axle 23 of a rotary display 25 which includes a disc 27 having a further aesthetic design 29 formed thereon.

Solar panels 30 and 32 are pivotably mounted on the base 11 and are supported in the horizontal position shown in FIG. 1 by virtue of brackets 31, 33.

Figure 2:
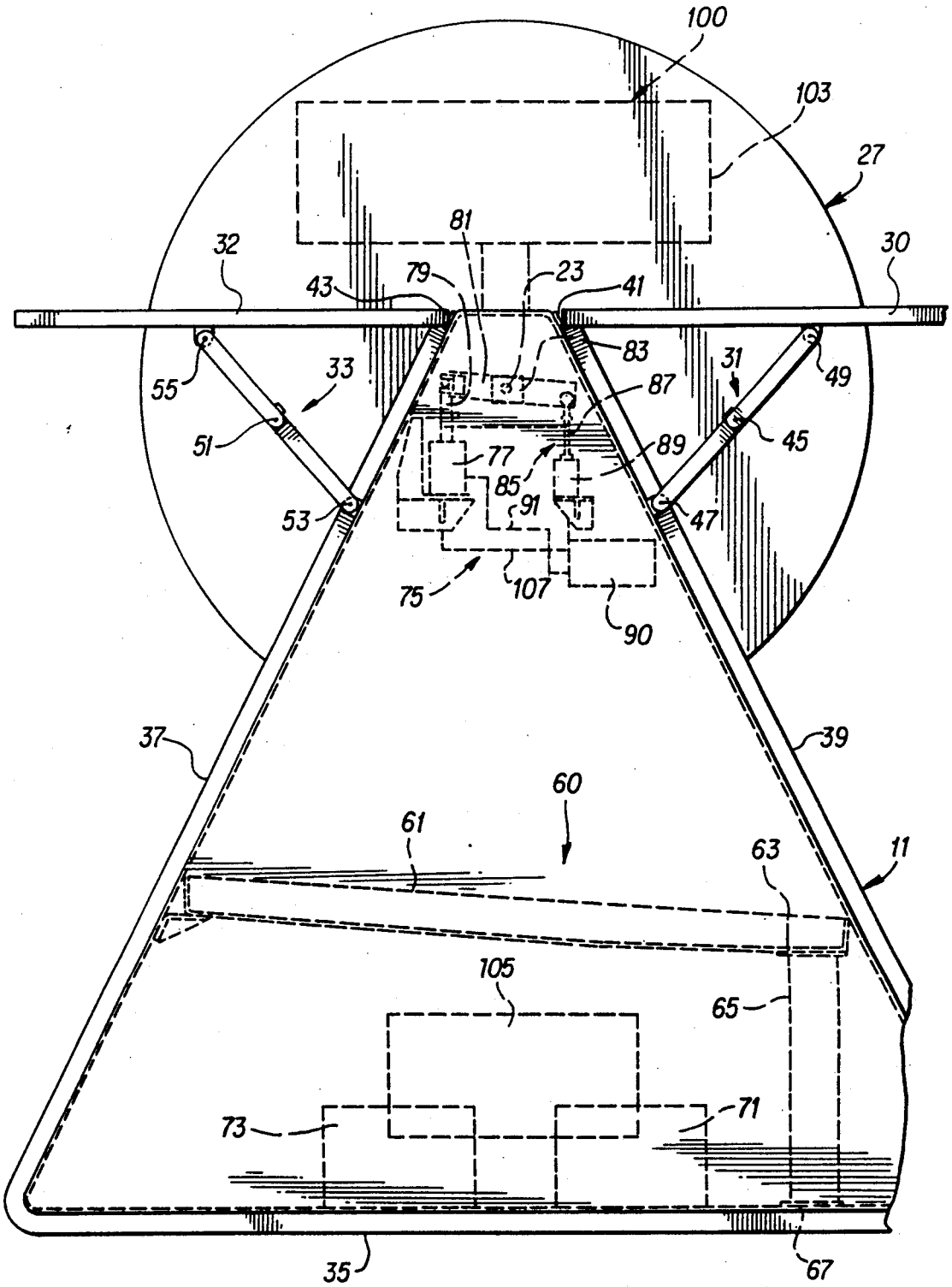
FIG. 2 shows a front view of the preferred embodiment shown in FIG. 1 enlarged and with portions omitted to show detail.

FIG. 2 depicts the inventive device 10 from the rear and shows the base 11 to include a bottom wall 35 as well as side walls 37 and 39 which converge from the bottom wall 35 to adjacency near the top of the base 11.

As best seen in FIG. 2, the solar panel 30 is pivoted on the base 11 by a hinge 41 while the solar panel 32 is pivoted on the base 11 by a hinge 43. Furthermore, the bracket 31 includes a central hinge 45 and end pivots 47 and 49, while the bracket 33 includes a central pivot 51 and end pivots 53 and 55. In a manner well known to those skilled in the art, the brackets 31, 33 may have an over-center mechanism adjacent the respective pivots 45, 51 to allow the panels 30, 32 to be locked in the position shown in FIGS. 1 and 2, with this mechanism being easily overridden when it is desired to fold the panels 30, 32 flat against the walls 37, 39 of the base 11.

Figure 3:
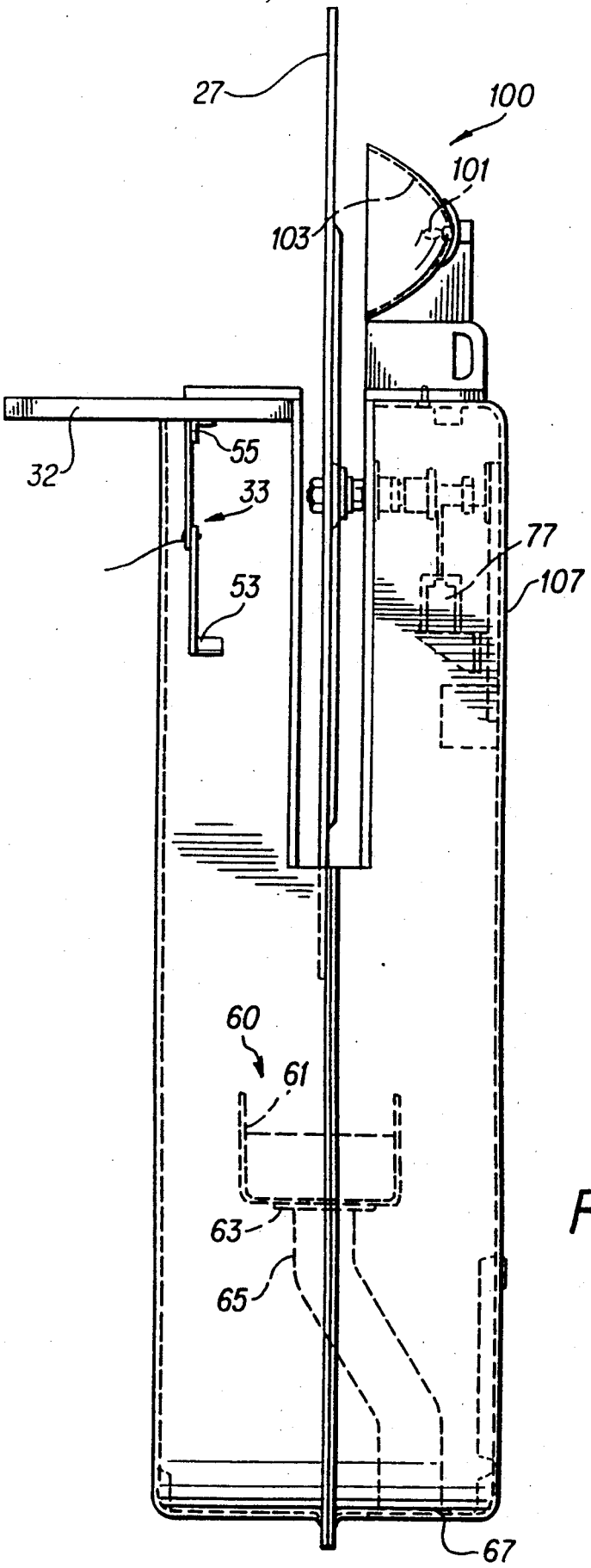
FIG. 3 shows a side view of the present invention with portions of the housing removed to show detail.

With reference to FIGS. 2 and 3, it is seen that a water trough and drain structure 60 is mounted in the base 11, including a through 61 which is angled in one direction, as best seen in FIG. 2, and which includes a port 63 fluidly communicating the trough 61 with a drain 65 having a bottom outlet 67 allowing the conveyance of fluid away from the base 11.

With reference to FIG. 2, it is seen that, preferably, two batteries 71 and 73 are placed on the bottom wall 35 of the base 11 and are interconnected into the electronic circuitry of the present invention in a manner to be described in greater detail hereinafter. Furthermore, FIG. 2 shows the drive mechanism 75 for the disc 27 of the movable display 25.

The drive mechanism 75 includes a solenoid 77 having a reciprocable plunger 79 with a lever 81 attached at its distal end. The lever 81 pivots about the axle 23 via a one-way bearing 83, the operation of which will be described in greater detail hereinafter.

At the other end of the lever 81, a counterweight 85 is provided including a stem 87 and a weight 89. The solenoid 77 is interconnected into the electronics 90 of the present invention by virtue of an electrical conductor 91.

As should be understood from FIG. 2, the drive mechanism 75 for the movable display 25 operates in the following manner: When the solenoid 77 is activated, such activation pulls the plunger 79 downwardly in the view of FIG. 2, thereby lifting the weight 89 and stem 87. When the solenoid 77 is deactivated, gravity acting upon the weight 89 tends to pivot the lever 81 in the clockwise direction in the view of FIG. 2 to thereby lift the plunger 79 back to the position shown in FIG. 2.

The one-way bearing 83 is designed so that when it is rotated in one direction via rotation of the lever 81 in one direction, force is transmitted to the disc 27. Conversely, when the lever 81 is rotated in the opposite direction, no force is transmitted, but the lever 81 is reset to a position wherein rotation in the first-mentioned direction will again impart force and thereby rotation to the disc 25.

As seen in FIGS. 2 and 3, illumination means 100 may be provided in the form of a strobe-type lamp 101 and a reflector 103. Alternatively, other illumination means such as pulsating, sequencing or flashing types may be provided rather than the depicted strobe-type lamp 101. The illumination means 100 is provided to facilitate illumination of the moving sign 25.

An access door 105 may be provided at the bottom of the base 11 to allow access to the interior thereof. A further access door 107 (FIG. 3) may be provided to allow access to upper regions of the base 11.

Figure 4:
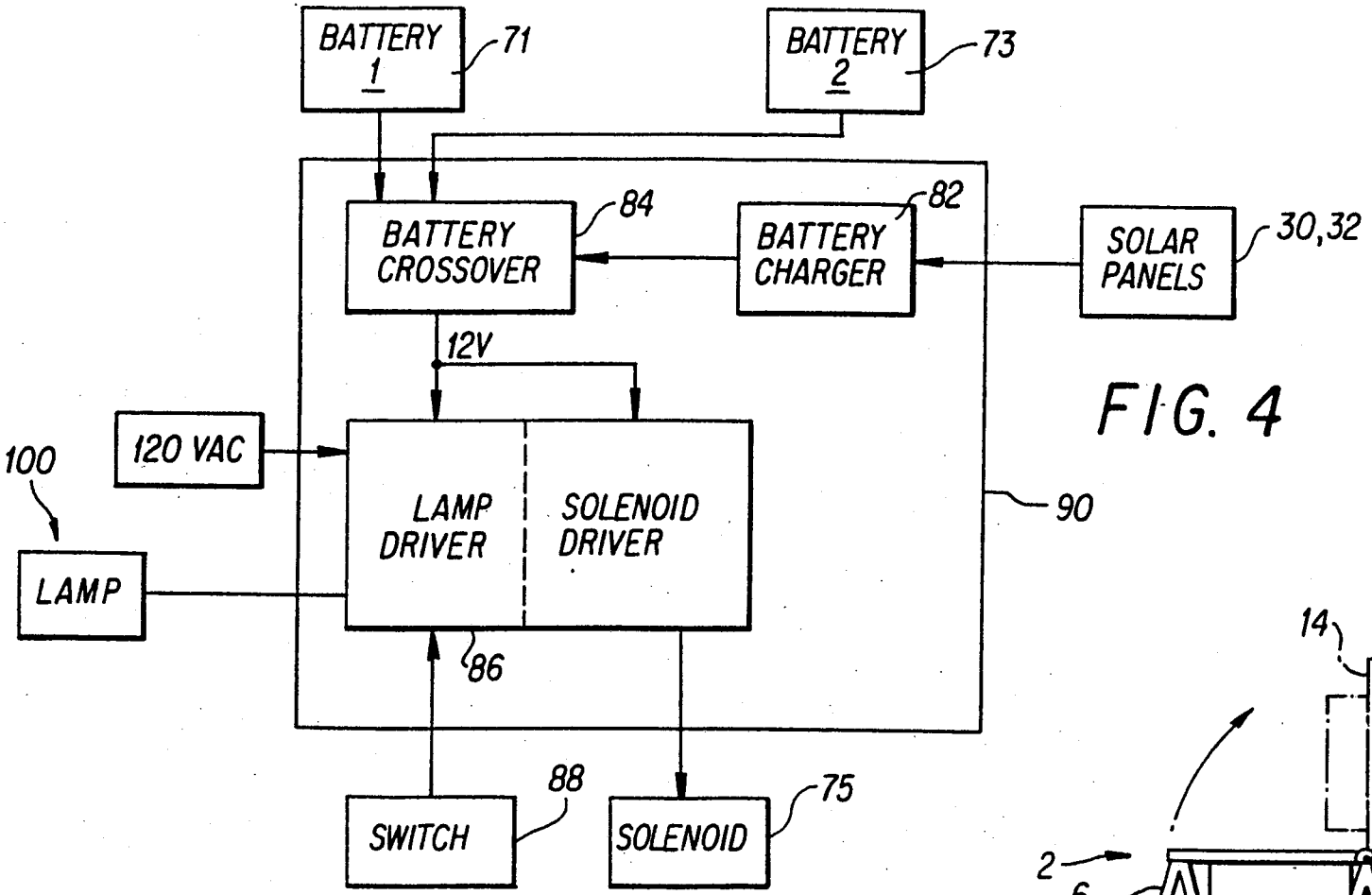
FIG. 4 shows a schematic representation of the electronic circuitry of the present invention.

With reference, now, to FIG. 4, it is seen that the electronic circuitry includes the enclosure 90 which contains battery charger 82, battery crossover circuit 84, and driver means 86 for the solenoid 75 as well as the illumination means 100. A switch 88 controls activation and deactivation of the entire system.

If desired, the illumination means 100 may operate on Alternating Current, preferably 110–120 V.A.C. Alternatively, the illumination means 100 may be battery powered and may be powered via the solar panels 30, 32, and the batteries 71, 73.

The battery crossover device 84 is designed to keep one battery charging while the other battery is being used to power the solenoid 75 and illumination means 100. The crossover device 84 includes means for sensing the output of one battery while sensing the degree of charge of the other battery. When the one battery is discharged below a predetermined level, the crossover device 84 will reverse connections so that the one battery is being charged via the solar panels 30, 32 and battery charger 82 and the other battery is being discharged to operate the inventive moving and fixed display.

Figure 5:
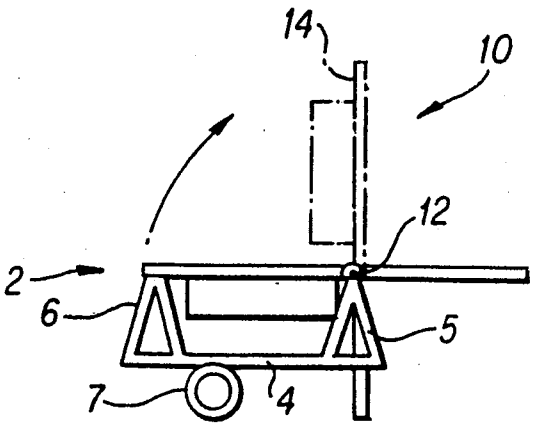
FIG. 5 shows a side view of one mode of transport of the inventive sign.

FIG. 5 shows the inventive sign 10 pivotably mounted at 12 on a trailer 2 having a bed 4, supports 5 and 6, and wheels 7. The support 5 carries the pivot 12 for the sign 10 while the support 6 supports the end 14 of the sign 10 when the sign 10 is pivoted to a stored and transporting position.

The trailer 2 may be used to easily transport the sign 10 and may be used to support the sign 10 while the display is being employed.

As such, an invention has been disclosed in terms of a preferred embodiment thereof which fulfills each and every one of the object of the invention as set forth hereinabove and provides a new and improved sign of great utility, ease of operation, and energy savings.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved sign comprising:

(a) a base having an internal chamber;

(b) said base having a face with a fixed display thereon;

(c) said base carrying a moving display;

(d) drive means for said moving display mounted on said base, said drive means being electrically operated;

(e) at least one solar panel pivotably mounted on said base between a first stored position lying against said base and a second deployed position extending out from said base; and (f) electrical means controllably conveying electrical power from said solar panel to said drive means.

2. The invention of claim 1, wherein said moving display comprises a rotary disc driven by said drive means.

3. The invention of claim 2, wherein said drive means includes a one-way bearing driven by sequential reciprocations of a solenoid actuated plunger.

4. The invention of claim 3, wherein said plunger is attached to a lever, said lever having a fulcrum attached to said bearing, said lever extending past said fulcrum with respect to said plunger and having a termination with biasing means attached thereto.

5. The invention of claim 4, wherein said biasing means comprises a weight.

6. The invention of claim 1, wherein a trough is contained in said chamber to collect fluids, and a drain is fluidly connected to said trough to allow drainage of said fluids therefrom.

7. The invention of claim 1, further including at least one battery electrically connected to said solar panel via a recharger, said at least one battery powering said moving display.

8. The invention of claim 7, wherein said at least one battery comprises two batteries and a crossover circuit connected therebetween, whereby one battery may power said moving display while another battery is being recharged by said recharger, and said crossover circuit may reverse connections so that said another battery may power said moving display while said one battery is being recharged.

9. The invention of claim 1, further including illumination means.

10. The invention of claim 9, wherein said illumination means comprises a strobe light.

11. The invention of claim 1, wherein said base includes an access door allowing access to said internal chamber.

* * * * *